US009297139B2

(12) United States Patent
Chrestia

(10) Patent No.: US 9,297,139 B2
(45) Date of Patent: Mar. 29, 2016

(54) ANCHOR FOR UNDERPINNING AND RETAINING WALLS

(71) Applicant: Vicente Luis Chrestia, Neuquen (AR)

(72) Inventor: Vicente Luis Chrestia, Neuquen (AR)

( * ) Notice: Subject to any disclaimer, the term of this patent is extended or adjusted under 35 U.S.C. 154(b) by 16 days.

(21) Appl. No.: 14/476,330

(22) Filed: Sep. 3, 2014

(65) Prior Publication Data

US 2015/0322643 A1 Nov. 12, 2015

(30) Foreign Application Priority Data

May 6, 2014 (AR) ..... 20140101836

(51) Int. Cl.
*E02D 27/50* (2006.01)

(52) U.S. Cl.
CPC ..... *E02D 27/50* (2013.01)

(58) Field of Classification Search
CPC ..... E02D 27/50
USPC ..... 405/230; 52/155, 160, 162, 164, 165
See application file for complete search history.

(56) References Cited

U.S. PATENT DOCUMENTS 152,091 A * 6/1874 Ellis ..... E02D 5/803 52/162
804,900 A * 11/1905 Templeman ..... E02D 5/803 52/164
836,678 A * 11/1906 Gallagher ..... E02D 5/803 52/164
912,018 A * 2/1909 McNutt ..... E02D 5/803 52/164
945,269 A * 1/1910 Fuchs ..... E02D 5/803 114/305
954,510 A * 4/1910 Fuchs ..... E02D 5/803 52/164
3,012,644 A * 12/1961 Bush ..... E02D 5/803 405/244
3,732,841 A * 5/1973 Mayo ..... B63B 21/28 114/295
2008/0271388 A1* 11/2008 Bayly ..... E02D 5/805 52/160
2015/0252546 A1* 9/2015 Berger ..... E04H 12/2215 52/160

* cited by examiner

*Primary Examiner* — Tara M. Pinnock
(74) *Attorney, Agent, or Firm* — Defillo & Associates, Inc; Evelyn A. Defillo

(57) ABSTRACT

The present invention refers to an anchorage for underpinning and bearing walls. The anchorage includes at least one head module and a brace tube which are joined coaxially together. The head module has a tapered point which serves as a guide and in the proximity to this point, the head module has at least two foldable blades on both sides of the brace tube. The blades present reinforcement ribs and tabs on their outer part and they are joined at one of their ends to the brace tube with a joint hinge and held at an upper third of the blades by a clamping device which is linked to the brace tube with a removable bolt. This removable bolt includes a knuckle pin with an end linked by a connector to the brace tube. The opposite end includes a clearance drilling angled at a slant, at 45 degrees of its axle, this end being inserted in the brace tube in correspondence with a bolt clamp.

6 Claims, 8 Drawing Sheets

ANCHOR FOR UNDERPINNING AND RETAINING WALLS

FIELD OF THE INVENTION

This invention refers to an "ANCHORAGE FOR UNDERPINNING AND BEARING WALLS". It more precisely refers to an anchor mechanism just as the mechanisms commonly used in the construction industry, in the works related to underpinning and bearing walls. The distinctive feature of this invention rests on its original design which is described herein and makes of this invention a totally recoverable and reusable device.

BACKGROUND OF THE INVENTION AND PROBLEMS TO BE SOLVED

Metal anchors for underpinning are commonly used in constructions requiring excavations deeper than 2 meters. These metal anchors comprise an anchor-bar which is embedded into the ground until it reaches the required depth. Upon reaching the calculated length, the anchorage takes place in the land and traction is exerted along the bar until it reaches the pre-set load or work load.

At last, and upon conclusion of the work or service period, these anchors permit the withdrawal of all bars and binding elements. This withdrawal helps to avoid the invasion and permanent obstruction caused by the anchor element in adjacent land and, therefore, helps to avoid any claims from the municipality or from neighbors.

To the date hereof, anchorages commonly used are "partially recoverable" since the anchorage head is left inside the land and cannot be recovered once it has served its purpose.

In order to solve these inconveniencies, this invention provides an original anchorage system that offers the following advantages:

This system enables full recovery of the anchor; therefore, the anchor neither invades nor obstructs neighbor and adjacent properties on a permanent basis and problems from an actual and legal standpoint are avoided.

It is inexpensive and it can quickly be placed and recovered.

It can be manufactured and installed at a very competitive price.

As it is easily recovered and reusable, costs are significantly reduced.

SUMMARY OF THE INVENTION

Therefore, the main subject matter of this invention includes an "ANCHORAGE FOR UNDERPINNING AND BEARING WALLS", meaning the kind of anchorage used in the construction industry, more specifically in underpinning works and bearing walls and it is recoverable in its entirety; which is characterized in that it comprises at least one head module and a brace tube which are joined together in a coaxial form; the head module has a tapered point which serves as a guide and in proximity to this point the head module has at least two foldable blades on both sides of the brace tube; the blades present reinforcement ribs and tabs on their outer part, and they are joined at one of their ends to the brace tube with a joint hinge and held at an upper third of the blades by a clamping device which is linked to the brace tube with a removable bolt. This removable bolt is comprised of a knuckle pin with an end linked by a connector to such brace tube, and the opposite end comprises a clearance drilling angled at a slant, at 45 degrees of its axle, this end being inserted in the abovementioned brace tube in correspondence with a bolt clamp; this bolt clamp is comprised of a cylindrical piece with at least four perforations, to wit: two radial drillings at 45 degrees of its axle which determine the place where the abovementioned bolts are inserted, and two lengthwise clearance drillings which coincide with the shape and position of the abovementioned bolts. These lengthwise clearance drillings determine the place where a clevis will be inserted. This clevis is comprised of an extractor rod that passes through the abovementioned brace tube and on its end there appear two points with conical ends that are joined together and that are simultaneously inserted in the two lengthwise clearance drillings of the above referenced bolt clamp and in the above referenced drilling angled at a 45-degree slant that comprise the abovementioned bolts.

A further object of this invention "ANCHORAGE FOR UNDERPINNING AND BEARING WALLS" is characterized in that the head module is comprised of four blades.

A further object of this invention "ANCHORAGE FOR UNDERPINNING AND BEARING WALLS" is characterized in that it comprises two four-blade head modules which are arranged in tandem with a clearance between them of no less than three times the diameter of the blades unfolded.

A further object of this invention "ANCHORAGE FOR UNDERPINNING AND BEARING WALLS" is characterized in that it comprises two head modules: one of the modules is comprised of four blades and the other module is comprised of two blades. These modules are arranged in tandem with a clearance between them of no less than three times the diameter of the blades unfolded.

A further object of this invention "ANCHORAGE FOR UNDERPINNING AND BEARING WALLS" in accordance with claim 1; CHARACTERIZED IN THAT such clamping device is a chain.

A further object of this invention "ANCHORAGE FOR UNDERPINNING AND BEARING WALLS" in accordance with claim 1; CHARACTERIZED IN THAT such clamping device is a cable.

BRIEF DESCRIPTION OF THE FIGURES

In order to better understand this invention and the manner in which it shall be put into practice, a series of illustrative figures have been developed to represent the following.

Figure 1:
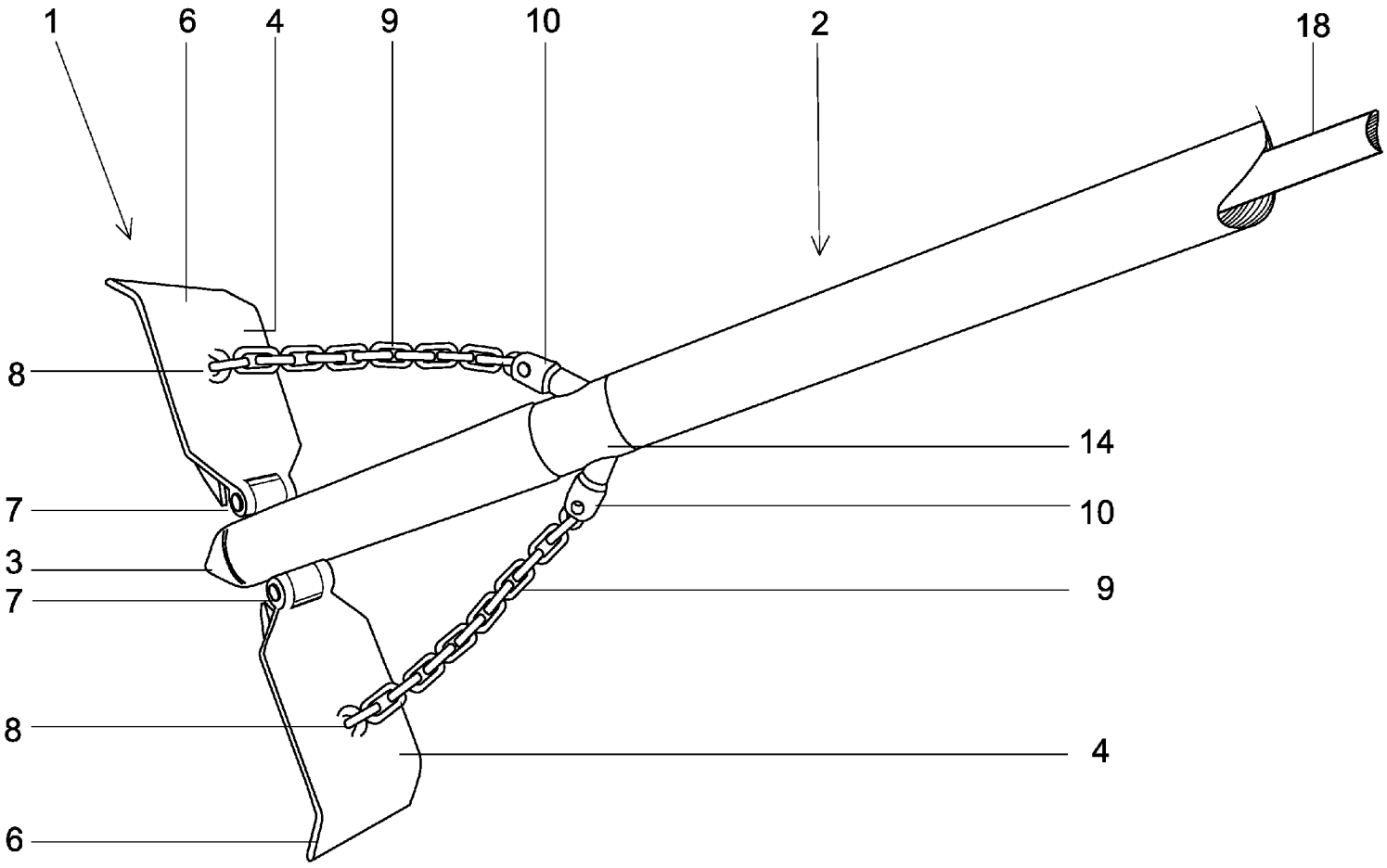
FIG. 1 is an overall perspective view of the anchorage.

A series of number references have been included in the figures, which represent:

1. HEAD MODULE.
2. BRACE TUBE.
3. TAPERED POINT WHICH SERVES AS A GUIDE.
4. BLADES.
5. REINFORCEMENT RIBS.

6. TABS.
7. JOINT HINGE.
8. UPPER THIRD.
9. CLAMPING DEVICE OF BLADES.
10. REMOVABLE BOLT.
11. KNUCKLE PIN.
12. CONNECTOR.
13. CLEARANCE DRILLING ANGLED AT A SLANT.
14. BOLT CLAMP.
15. RADIAL DRILLINGS.
16. LENGTHWISE CLEARANCE DRILLINGS.
17. CLEVIS.
18. EXTRACTOR ROD.
19. POINTS.

DETAILED DESCRIPTION OF THE INVENTION

By making use of the number references included in the figures, it will be explained in detail below how this invention is used and what does it comprise of.

As it may be observed in the FIGS. 1 through 5, ANCHORAGE FOR UNDERPINNING AND BEARING WALLS consists of a head module (1) and a brace tube (2) which are joined together in a coaxial form. The head module (1) has a tapered point which serves as a guide (3) and in proximity to this point the head module has (3) two blades (4) which are characterized in that they are foldable and placed on both sides of the brace tube (2). The blades (4) present reinforcement ribs (5) and tabs (6) on their outer part, and they are joined at one of their ends to the brace tube (2) with a joint hinge (7) and held at an upper third (8) of the blade (4) by a clamping device (9) which is linked to the brace tube (2) with a removable bolt (10). This removable bolt (10) consists of a knuckle pin (11) with an end linked by a connector (12) to such clamping device (9), and the opposite end comprises a clearance drilling angled at a slant (13), at 45 degrees of its axle, this end (13) being inserted in the abovementioned brace tube (2) in correspondence with a bolt clamp (14). This bolt clamp (14) consists of a cylindrical piece with at least four perforations, to wit: two radial drillings (15) at 45 degrees of its axle; these radial drillings (15) determine the place where the abovementioned bolts are inserted (10); and two lengthwise clearance drillings (16) which coincide with the shape and position of the abovementioned bolts (10). These lengthwise clearance drillings (16) determine the place where a clevis with a removable clamp will be inserted (17). This clevis (17) consists of an extractor rod (18) that passes through the abovementioned brace tube (2) and on its end there appear two points joined together (19) with conical ends that are simultaneously inserted in the two lengthwise clearance drillings (16) of the above referenced bolt clamp (14) and in the above referenced drilling angled at a 45-degree slant (13) that comprise the abovementioned bolts (10).

Figure 6:
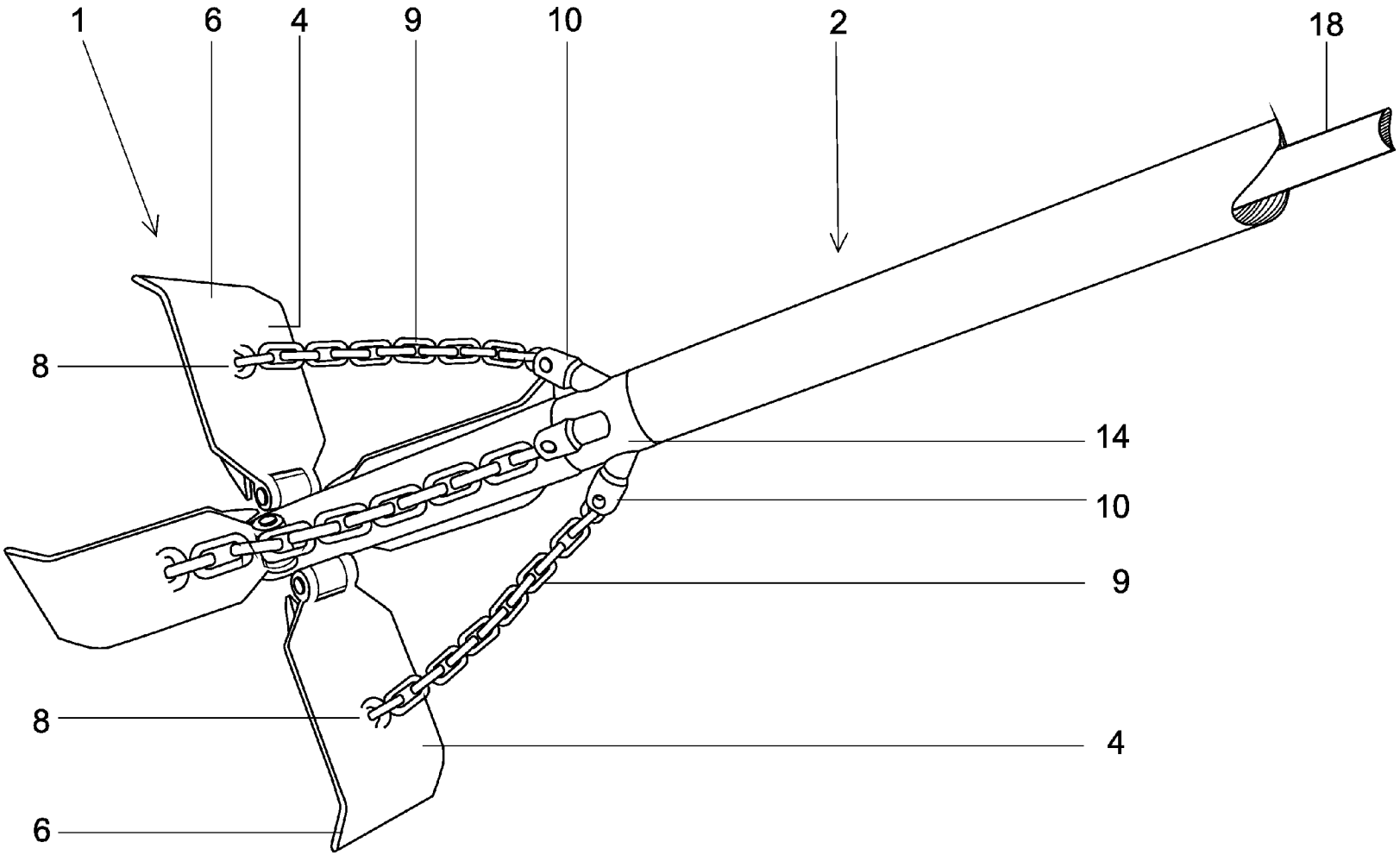
FIG. 6 is an embodiment of this invention with one four-blade head.

FIG. 6 shows a graphic of an embodiment in accordance with this invention, which consists of a head module (1) with four blades (4) characterized in that they are foldable and in cross shape and arranged on both sides of the brace tube (2).

Figure 7:
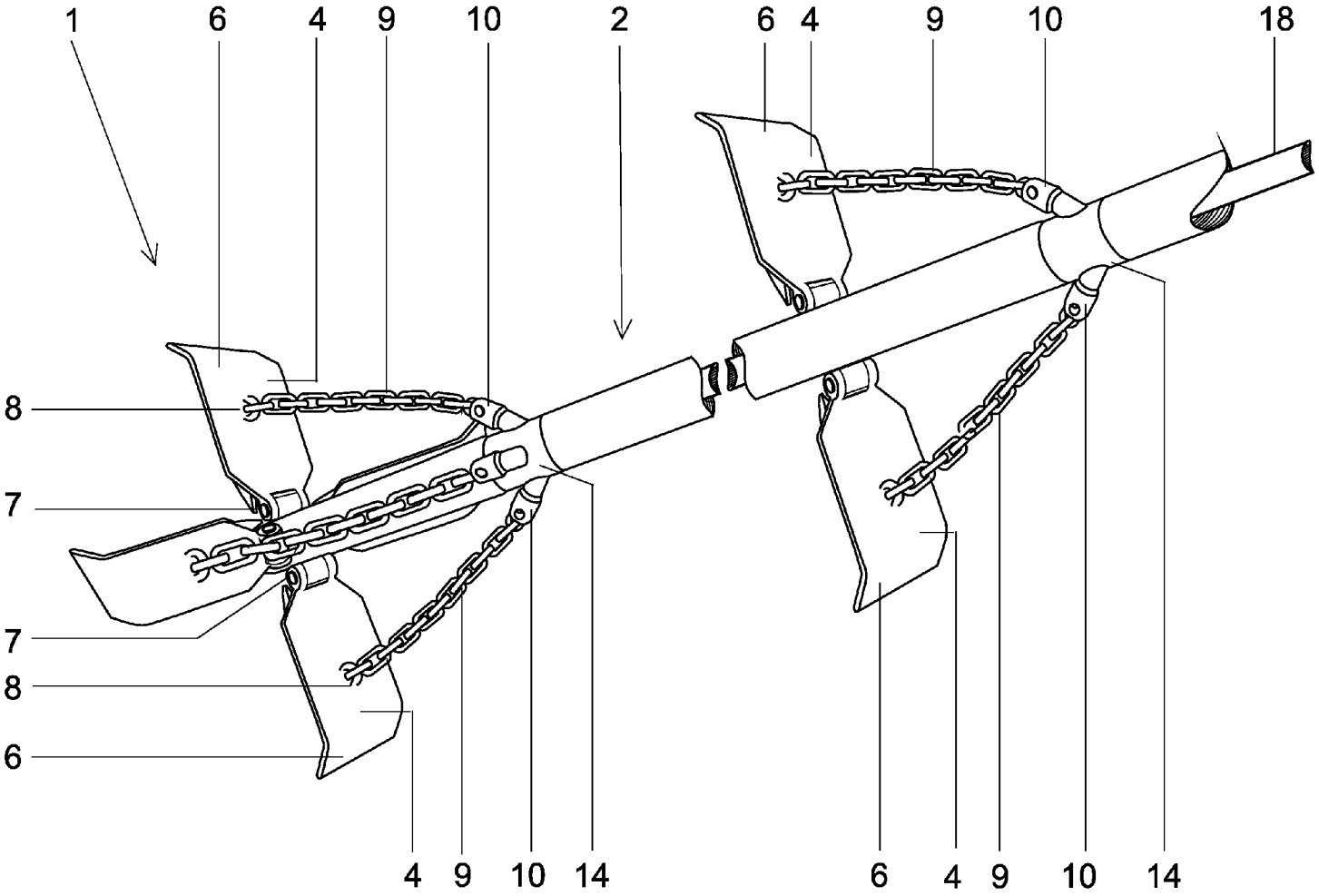
FIG. 7 is another embodiment of this invention with two heads, to wit: a four-blade head and a two-blade head arranged in tandem.

Furthermore, FIG. 7 shows another embodiment in accordance with this invention, which consists of a head module (1) with four blades (4) characterized in that they are foldable and in cross shape and arranged on both sides of the brace tube (2) and another head module (1) with two blades (4) characterized in that they are foldable and arranged on both sides of the brace tube (2). These head modules (2) are arranged in tandem with a clearance between them of no less than three times the diameter of the blades (4) unfolded.

Figure 8:
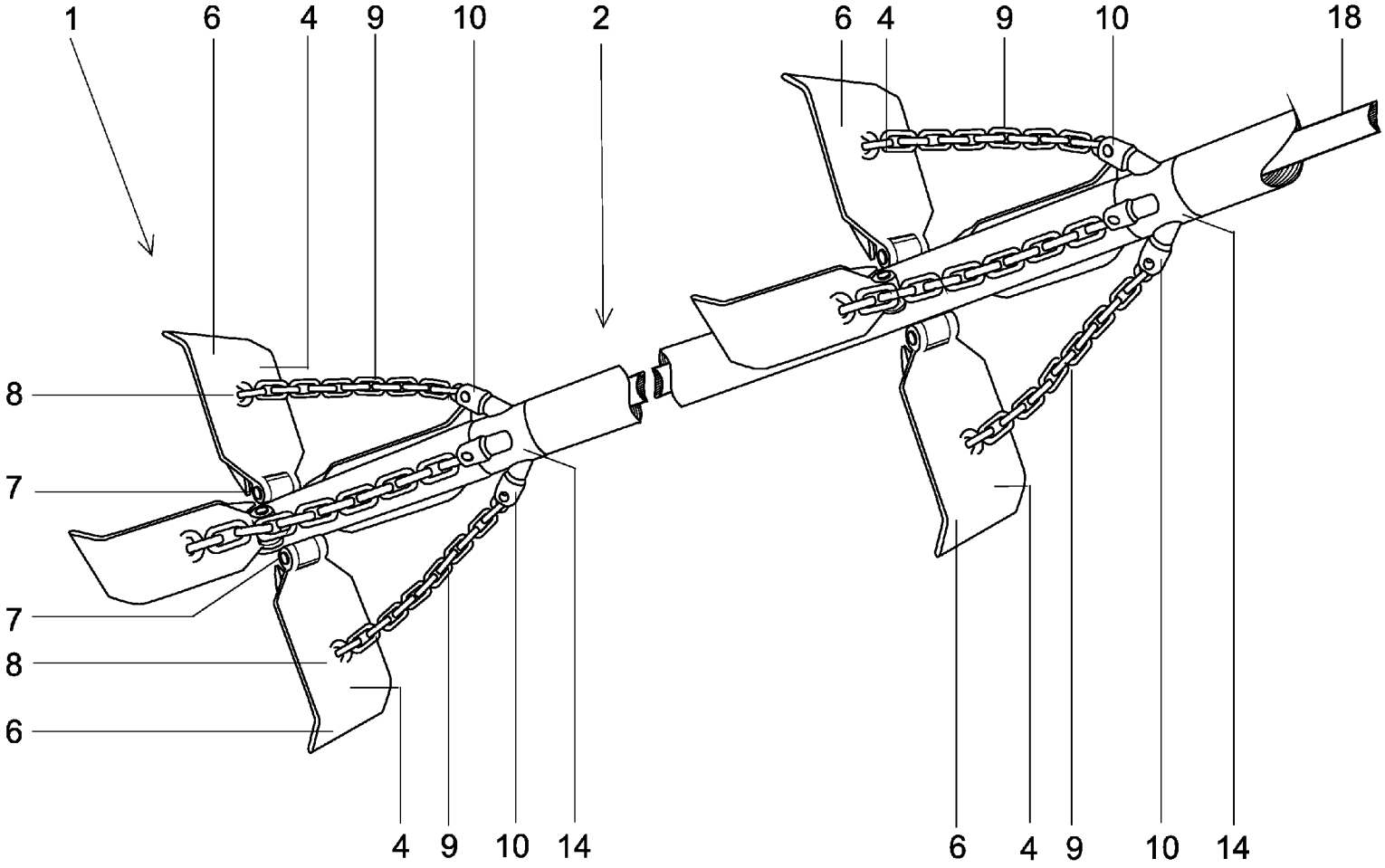
FIG. 8 is another embodiment of this invention with two four-blade heads arranged in tandem.

FIG. 8 shows a graphic of an embodiment in accordance with this invention, which consists of a head module (1) with four blades characterized in that they are foldable and in cross shape on both sides of the brace tube (2) and a like head module (1) with four blades (4) characterized in that they are foldable and in cross shape on both sides of the brace tube (2). These head modules (2) are arranged in tandem with a clearance between them of no less than three times the diameter of the blades (4) unfolded.

Figure 2:
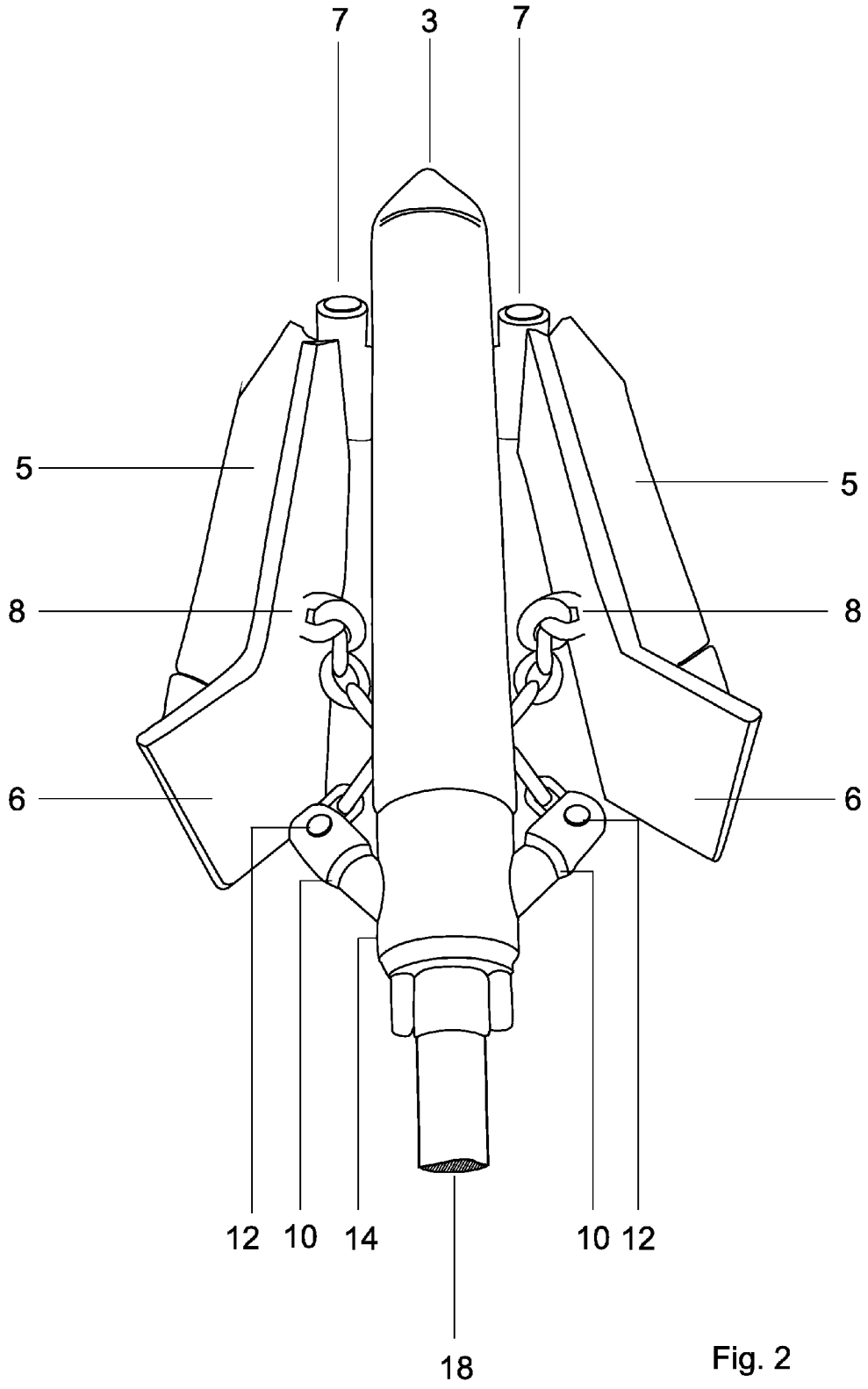
FIG. 2 is a perspective view of the anchor shown as it is embedded into the ground.

The invention ANCHORAGE FOR UNDERPINNING AND BEARING WALLS operates as follows:

In order to embed this anchorage into the ground, the head module (1) of the anchorage should be in the position plotted in FIG. 2, i.e., the blades should be turned backwards almost in parallel to the brace tube (2).

Figure 3:
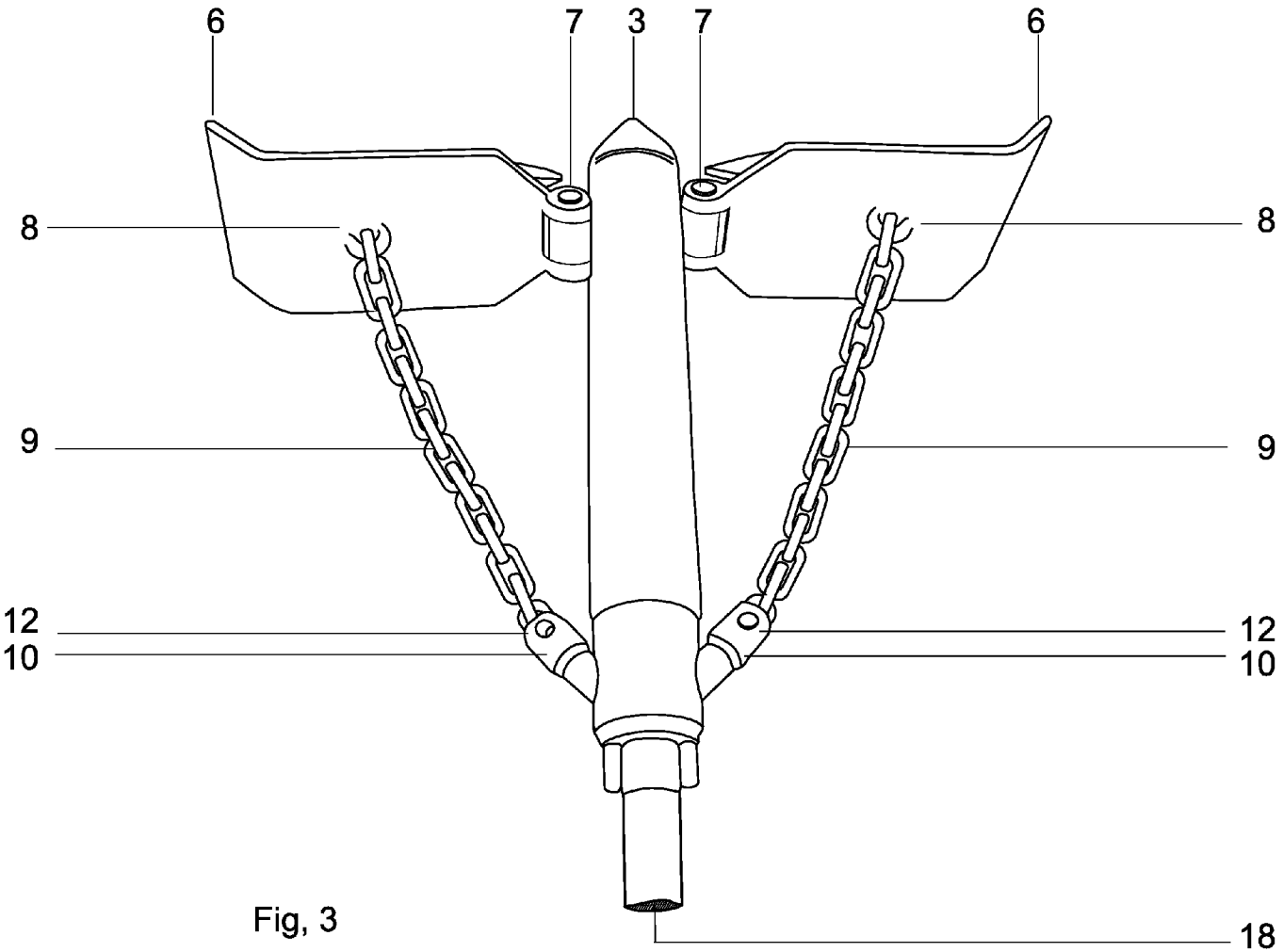
FIG. 3 is a perspective view of the anchor shown in its operative position.
Figure 4:
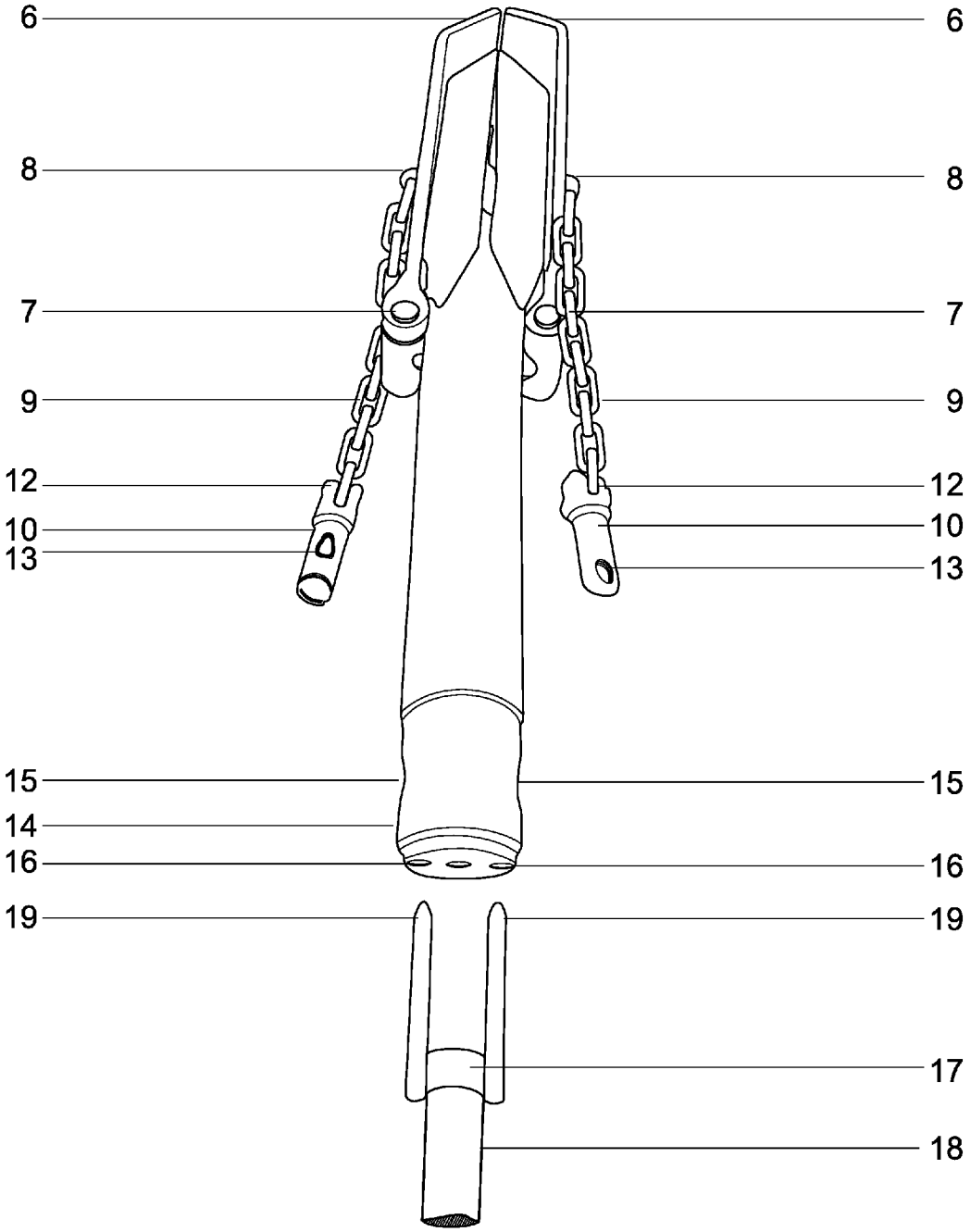
FIG. 4 is a perspective view of the anchor shown in the position of extracting land.
Figure 5:
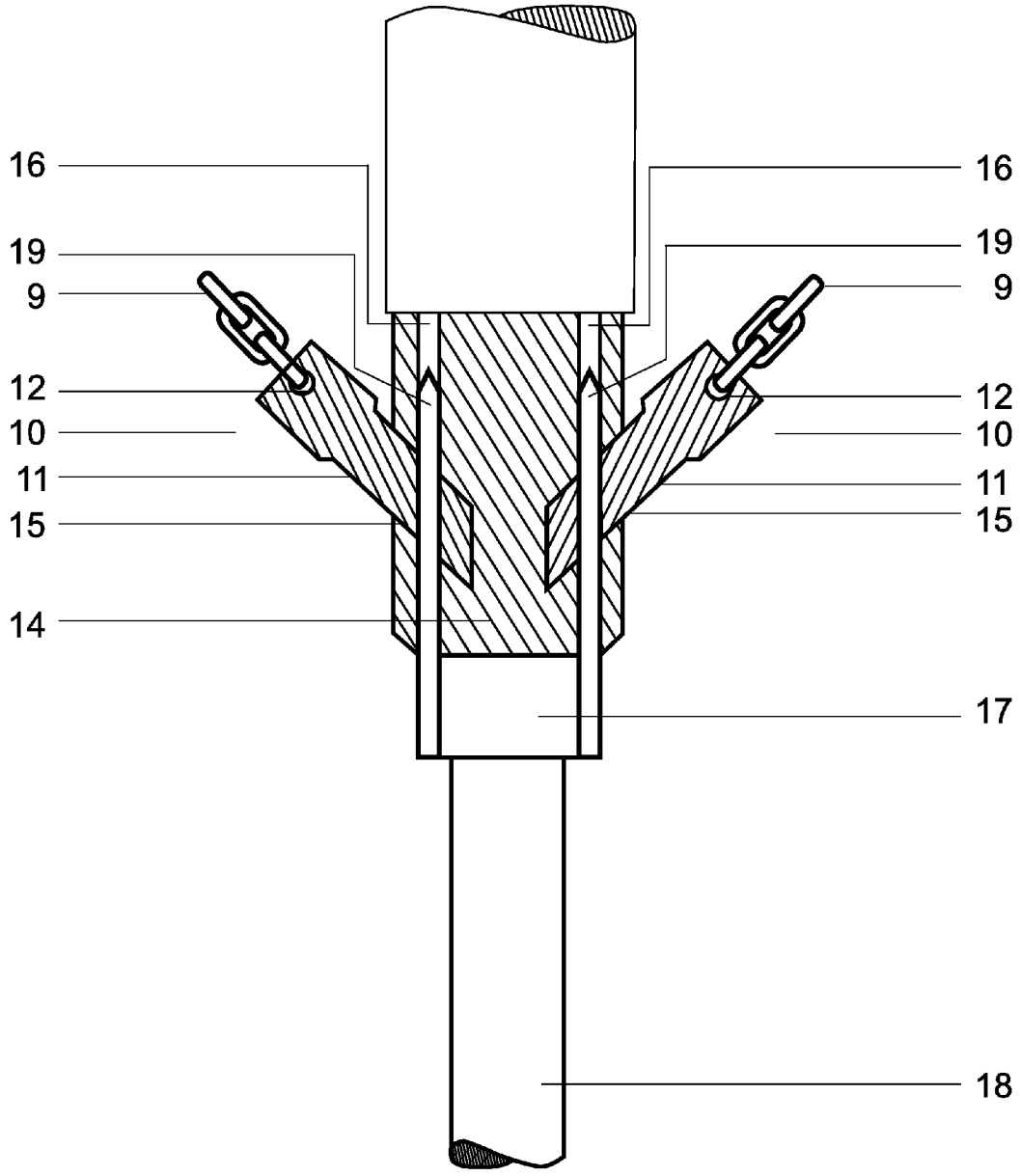
FIG. 5 constitutes a cut showing a partial detail of the bolt clamp mechanism.

Upon reaching the calculated length, traction is exerted from the outside along the brace tube (2) in an upward direction until achieving the pre-set load or work load that, with the aid to the tabs (6), cause the blades (4) to unfold due to land friction; thus adopting the blades the position plotted on FIG. 3, i.e., completely unfolded and perpendicular to the brace tube (2) and held in that position with the aid of the blade clamps (9) and their removable bolts (10).

Upon conclusion of the work, the extractor rod (18) is pulled making the clevis (17) move with its points (19) and causing the release of the bolts (10), enabling the blades (4) to freely rotate due to the joint hinges (7). At that moment, traction is exerted along the brace tube (2) and such blades (4) with the aid of the tabs (6), adopt the position plotted in FIG. 4, i.e., in an upward direction, turned backwards and parallel to the brace tube (2). Therefore, the anchorage is totally withdrawn from the land without leaving any parts buried or interferences whatsoever in adjacent properties, the anchorage being ready to be reused.

In those cases where the work load should be increased, the embodiments plotted in FIGS. 6, 7, and 8 will be used. These embodiments enable the permissible work load to be increased twofold or fourfold.

Having particularly described and determined the nature and scope of this invention, as well as the way in which it is to be put into practice, the following is declared to be claimed of exclusive right and ownership:

The invention claimed is:

1. An anchorage for underpinning and bearing walls comprising:

a head module;

a brace tube coaxially joined to the head module;

the head module includes:

a tapered point section;

a foldable blade located on each end of the tapered point section, each foldable blade includes a first end located near to the tapered point section and connected to the brace tube by a hinge, a second end located opposite to the first end and including a tab, an outer end including a reinforcement rib, and an inner end including a clamping device, the clamping device is linked to the brace tube by a bolt;

the bolt includes a pin with a first end linked by a connector to the brace tube and a second opposite end a clearance drilling angled at a slant of 45 degrees, the second end being inserted in the brace tube with a bolt clamp;

the bolt clamp includes a cylindrical piece with at least four perforations including two radial perforation at 45 degrees which determine the place where the bolts are inserted and two lengthwise perforations which coincide with the shape and position of the bolts;

the lengthwise perforations determine the place where a clevis is inserted, the clevis includes an extractor rod that passes through the brace tube and a two arms having conical ends that are inserted in the two lengthwise perforations of the bolt clamp and in the drilling angled at a 45-degree slant that comprise the bolts.

2. The anchorage according to claim 1, wherein the head module includes four foldable blades.

3. The anchorage according to claim 1, wherein the head module includes four two foldable blade head modules which are arranged in tandem with a clearance between them of no less than three times the diameter of the unfolded blades.

4. The anchorage according to claim 1, wherein the head module comprises:

a first module having four foldable blades; and a second module having two foldable blades;

the first and the second module are arranged in tandem with a clearance between them of no less than three times the diameter of the blades unfolded.

5. The anchorage according to claim 1, wherein the clamping device is a chain.

6. The anchorage according to claim 1, wherein the clamping device is a cable.

* * * * *